US009299315B2

(12) United States Patent
Chen et al.

(10) Patent No.: US 9,299,315 B2
(45) Date of Patent: Mar. 29, 2016

(54) SOURCE DRIVING CIRCUIT AND DATA TRANSMISSION METHOD THEREOF

(71) Applicant: RAYDIUM SEMICONDUCTOR CORPORATION, Hsinchu (TW)

(72) Inventors: Ying-Lieh Chen, Tainan (TW); Wen-Tsung Lin, Tainan (TW); Li-Ping Lin, Tainan (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 358 days.

(21) Appl. No.: 13/959,703

(22) Filed: Aug. 5, 2013

(65) Prior Publication Data

US 2014/0253566 A1 Sep. 11, 2014

(30) Foreign Application Priority Data

Mar. 11, 2013 (TW) ..... 102108516 A

(51) Int. Cl.
*G09G 3/20* (2006.01)
*G09G 5/00* (2006.01)

(52) U.S. Cl.
CPC ..... *G09G 5/006* (2013.01); *G09G 3/2096* (2013.01); *G09G 2300/0408* (2013.01); *G09G 2310/0275* (2013.01)

(58) Field of Classification Search
CPC ..... G09G 5/006; G09G 3/2096
See application file for complete search history.

(56) References Cited

U.S. PATENT DOCUMENTS

2013/0235055 A1* 9/2013 Kim ..... G09G 5/006 345/545
2014/0036044 A1* 2/2014 Choi ..... H04N 13/0438 348/51

* cited by examiner

*Primary Examiner* — Idriss N Alrobaye
*Assistant Examiner* — Ronald Modo

(57) ABSTRACT

A source driving circuit is disclosed. The source driving circuit includes a first integrated source driver and a second integrated source driver. The first integrated source driver includes a first receiving unit, a timing controller, a first source-driving-unit and a first transmission unit. The first receiving unit receives an original image data through a displayport (DP) interface, and decodes the original image data to a first display data and a second display data. The timing controller transmits a first control signal and a second signal. The first source-driving-unit receives the first control signal and the first display data. The first transmission unit receives the second display data, and the second integrated source driver receives the second control signal and the second display data, so as to elevate the compatibility between the source driver and the DP interface.

6 Claims, 6 Drawing Sheets

SOURCE DRIVING CIRCUIT AND DATA TRANSMISSION METHOD THEREOF

BACKGROUND OF THE DISCLOSURE

1. Field of the Disclosure

The instant disclosure relates to a source driving circuit; in particular, to a source driving circuit which is compatible to a displayport interface or an embedded displayport (eDP) interface for a data or signal transmission.

2. Description of Related Art

In recent years, manufacturers have been in competition for specifications of laptops and tablets, from hard disk size, to central processing unit (CPU) speed, to an increase of screen resolution. Branded manufacturers not only equip their products with panels of an upgraded level from a (1,366×768) high-definition (HD) to a full high-definition (1,920×1,080), but also have begun to import a three-dimensional (3D) display function, which leads to a result that the image of traditional interface and design structure becomes less satisfying, and a more state-of-the-art digital interface is required for a high-speed video signal communication between a screen and the graphics processor (GPU), and is also required for supporting demand of a higher resolution. In comparison to a traditional LVDS interface, a digital eDP has a higher transferring rate, and is suitable for a high-resolution panel; the digital eDP interface also reduces the cable number so as to achieve a thin shaped design. In addition, the eDP utilizes the same protocol as DisplayPort so that it is possible to share an image outputting port of the GPU, and the specification of the latest generation of eDP 1.3 may further reduce power consumption of the GPU so as to extend the battery life significantly.

eDP is an interface especially designed for an embedded system, and is able to transfer large amounts of data with less pins, and provides great flexibility to a design of hardware mechanism, which not only releases more hinge designing space, but also greatly reduces complexity of the cable, suitable for a notebook computer, a tablet, or an All-in-one PC; in comparison to an exterior DisplayPort, the specification of the eDP is quite adjustable according to various scenarios. In particular, the eDP significantly improve defects of the LVDS so that there is no need for the GPU to reserve an image outputting port for an embedded display panel, and a Main Link Lane number and a data transferring rate may be adjusted according to a data transferring amount shown on a display panel; AUX Channel of the eDP also provides an extra channel for GPU to control a various parameter setting on a display panel.

However, if a timing controller is integrated to a source driver, a connecting method of the traditional LVDS does not work for a protocol of DP/eDP, and thus this inconsistent specification between new and old hardware may lead to a problem of incompatibility of hardware.

SUMMARY OF THE DISCLOSURE

The instant disclosure provides a source driving circuit, and the source driving circuit is connected to a displayport interface, wherein the displayport interface receives and transmits an original image data to the source driving circuit, and the source driving circuit includes a first integrated source driver and a second integrated source driver. The first integrated source driver is connected to the displayport interface through a flexible printed circuit board, and the second integrated source driver is connected to the first integrated source driver. The first integrated source driver includes a first receiving unit, a timing controller, a first source-driving-unit, and a first transmission unit. The first receiving unit is connected to and through the displayport interface to receive an original image data, decoding the original image data to an original image data decoded. The timing controller is connected to the first receiving unit, and the timing controller receives the original image data decoded and transmitted by the first receiving unit, and transmits a first control signal and a second control signal, wherein the original image data decoded includes a first display data and a second display data. The first source-driving-unit is connected to the timing controller to receive the first control signal and the first display data. The first transmission unit is connected to the timing controller, and the first transmission unit receives the second display data transmitted by the timing controller. The second integrated source driver receives the second control signal transmitted by the timing controller and the second display data transmitted by the first transmission unit.

In an embodiment of the instant disclosure, a data transmission method of a source driving circuit is provided, and the data transmission method include steps as follows: receiving an original image data through a displayport interface, decoding an original image data into an original image data decoded; receiving an original image data decoded by the first receiving unit and transmitted by a timing controller, and transmitting a first control signal and a second control signal, wherein the original image data decoded includes a first display data and a second display data; receiving the first control signal through a first source-driving-unit and receiving the first display data; receiving the second display data transmitted by the timing control through the first transmission unit; and receiving the second control signal transmitted by the timing control through the second integrated source driver and the second display data transmitted by the first transmission unit.

To sum up, with the timing controller integrated to the source driving circuit, the source driving circuit and the data transmission method thereof in the embodiment of the instant disclosure are able to proceed a data or signal transmission and reception according to the displayport interface or an embedded displayport interface within the displayport interface specification standard. In other words, the source driving circuit and the data transmission method and the standard specification of the displayport interface or the embedded displayport interface are compatible so as to meet the requirement of a signal transmission and frequency demand brought by a high data transmission rate and high resolution.

For further understanding of the instant disclosure, reference is made to the following detailed description illustrating the embodiments and examples of the instant disclosure. The description is only for illustrating the instant disclosure, not for limiting the scope of the claim.

DETAILED DESCRIPTION OF PREFERRED EMBODIMENTS

Figure 1:
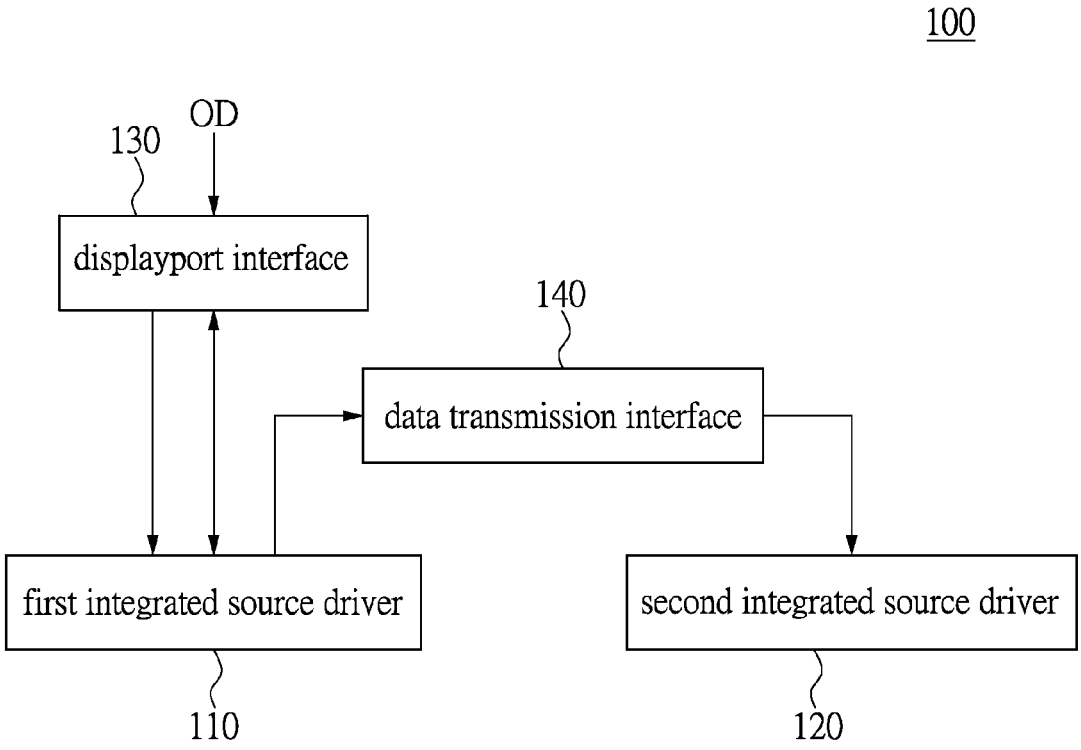
FIG. 1 shows a schematic block diagram of a source driving circuit according to an embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings. In the drawings, the size and relative sizes of layers and regions may be exaggerated for clarity.

It will be understood that, although the terms first, second, third, and the like, may be used herein to describe various elements, components, regions, layers and/or sections, these elements, components, regions, layers and/or sections should not be limited by these terms. These terms are only to distinguish one element, component, region, layer or section from another region, layer or section discussed below could be termed a second element, component, region, layer or section without departing from the teachings of the instant disclosure. As used herein, the term "and/or" includes any and all combinations of one or more of the associated listed items.

Referring to FIG. 1, FIG. 1 shows a schematic block diagram of a source driving circuit according to an embodiment of the instant disclosure. As shown in FIG. 1, the source driving circuit 100 includes a first integrated source driver 110 and a second integrated source driver 120. In the present embodiment, the first integrated source driver 110 is connected to the second integrated source driver 120 through a data transmission interface 140, and the first integrated source driver 110 is connected to a DisplayPort 130 through a flexible printed circuit board (not shown in FIG. 1); wherein, the first integrated source driver 110 and the second integrated source driver 120 are equipped on another display panel (not shown in FIG. 1), wherein the displayport interface 130 is a whole digitalized interface with a high transmission rate, and in an embodiment, the data transmission interface 140 is built inside the first integrated source driver 110 and also built inside the second integrated source driver 120, and thus a drawing in FIG. 1 is simply for an easy instruction, not to limit the scope of the instant disclosure. In it worth mentioning that, in another embodiment, the first integrated source driver 110 does not need the data transmission interface 140 to be connected to the second integrated source driver 120, but to be connected to the second integrated source driver 120 through a metal wiring on the display panel for transmitting data or signals. In addition, in the present embodiment, the first integrated source driver 110 and the second integrated source driver 120 integrate a traditional timing controller and the source driving unit, and the displayport interface 130 may also be an embedded DisplayPort (eDP) for an application in consumer electronic devices as a display interface, such as a laptop. As for a specification of the eDP of a laptop, traces which are needed inside for a laptop may be reduced to a number of 2-4 so that the trace of interfaces inside a hinge of a traditional laptop will be much less complicated.

In the following teaching, there is the further instruction of a working mechanism of the source driving circuit 100 of the instant disclosure. The following instruction is taken as an example from the specification of a displayport interface of a regular display device, and so from the specification of an embedded displayport interface of a laptop, and it is not repeated thereto.

People skilled in the art should be able to realize that a high speed digital video-audio transmitting interface is a main stream of a video-audio player. Therefore, in the embodiment, when the displayport interface 130 receives an original image data OD (which means a digital video data compressed), the displayport interface 130 is connected to the first integrated source driver 110 through a Main link and an Auxiliary link so as to transmit the original image data OD to the first integrated source driver 110. After the first integrated source driver 110 receives the original image data OD, the original image data OD will be decoded so as to retrieve an video-audio information and a control signal both carried by the original image data OD. In the present embodiment, the first integrated source driver 110 decodes the original image data OD into an decoded original image data, wherein the decoded original image data includes a first display data and a second display data, wherein the first display data (i.e. a first grey scale voltage value) is pixel transmitted from the first integrated source driver 110 to the display panel so as to display an image, and the second display data (i.e. a second grey scale voltage value) is pixel transmitted from the second integrated source driver 120 to the display panel so as to display an image. Afterwards, the first integrated source driver 110 will transmit the second display data and the control signal to the second integrated source driver 120 through the data transmission interface 140 so as to drive the second integrated source driver 120, wherein the data transmission interface 140 is a one-to-many interface, such as a Low Voltage Differential Signal (LVDS), Transistor-transistor logic (TTL), a Reduced Swing Differential Signaling (RSDS), or a Multipoint LVDS (mLVDS), or any other interface which is one-to-many supported.

It is worth noting that, in the present disclosure, the first integrated source driver 110 is an active driver (Master driver), but the second integrated source driver 120 is a slave driver, and through the first integrated source driver 110, it is able to proceed a video image transmission and reception with the displayport interface 130 one by one, and through the first integrated source driver 110, the required image information and the control signal are transmitted from the data transmission interface 140 to the second integrated source driver 120. Therefore, the source driving circuit 100 of the instant disclosure is compatible with the displayport interface 130 in the same consumer electronic device, and is able to meet the requirement of a signal transmission and frequency demand brought by a high data transmission rate and high resolution.

Figure 2:
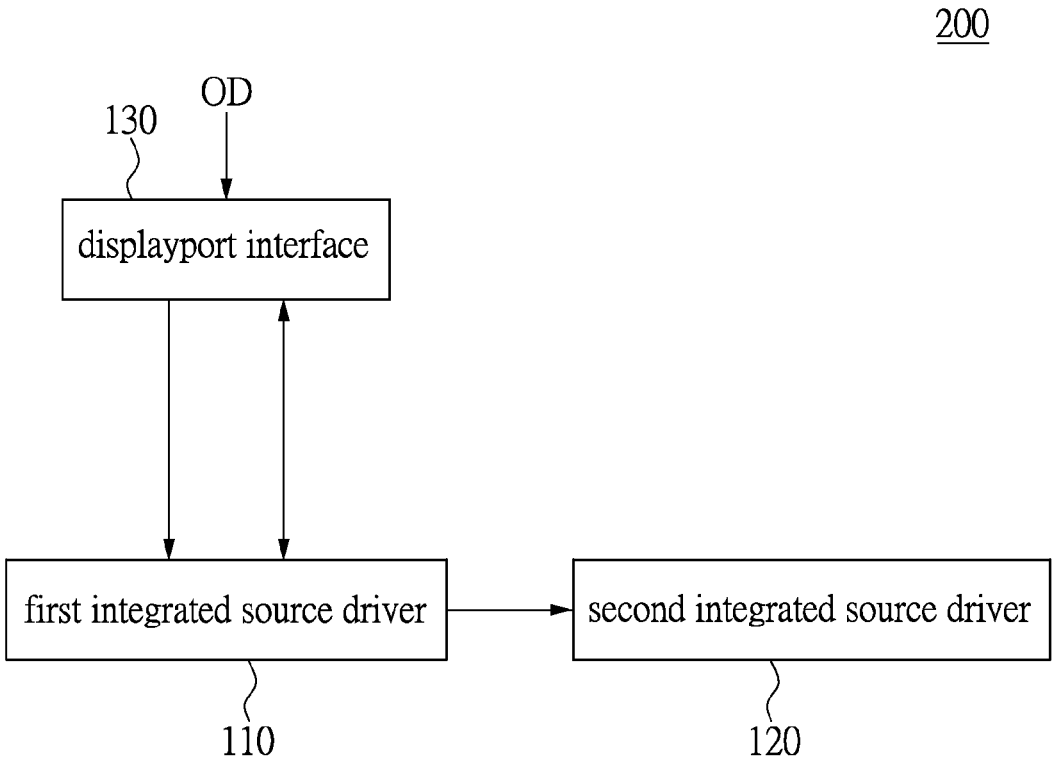
FIG. 2 shows a schematic block diagram of a source driving circuit according to an embodiment of the instant disclosure.

Referring to FIG. 2, FIG. 2 shows a schematic block diagram of a source driving circuit according to an embodiment of the instant disclosure. In the present embodiment, different from the embodiment in FIG. 1, the first integrated source driver 110 does not need the data transmission interface 140 as shown in FIG. 1 to transmit a display data and a control signal to the second integrated source driver 120. Furthermore, the first integrated source driver 110 transmits the data and the signal to the second integrated source driver 120 through a wiring on the display panel, so that a circuit cost related to the configuration of the data transmission interface 140 is cut down. The rest of the work mechanism of the source driving circuit 200 in the present embodiment is identical to or similar to the source driving circuit 100 of the embodiment in FIG. 1 as recited above, and thus it is not repeated thereto.

There is further instruction in teaching a detailed circuit block and a related operation of the source driving circuit 100 of the embodiment in FIG. 1. As for a detailed operation of the embodiment in FIG. 2, a work mechanism shown in FIG. 3 also helps in understanding the instant disclosure.

Figure 3:
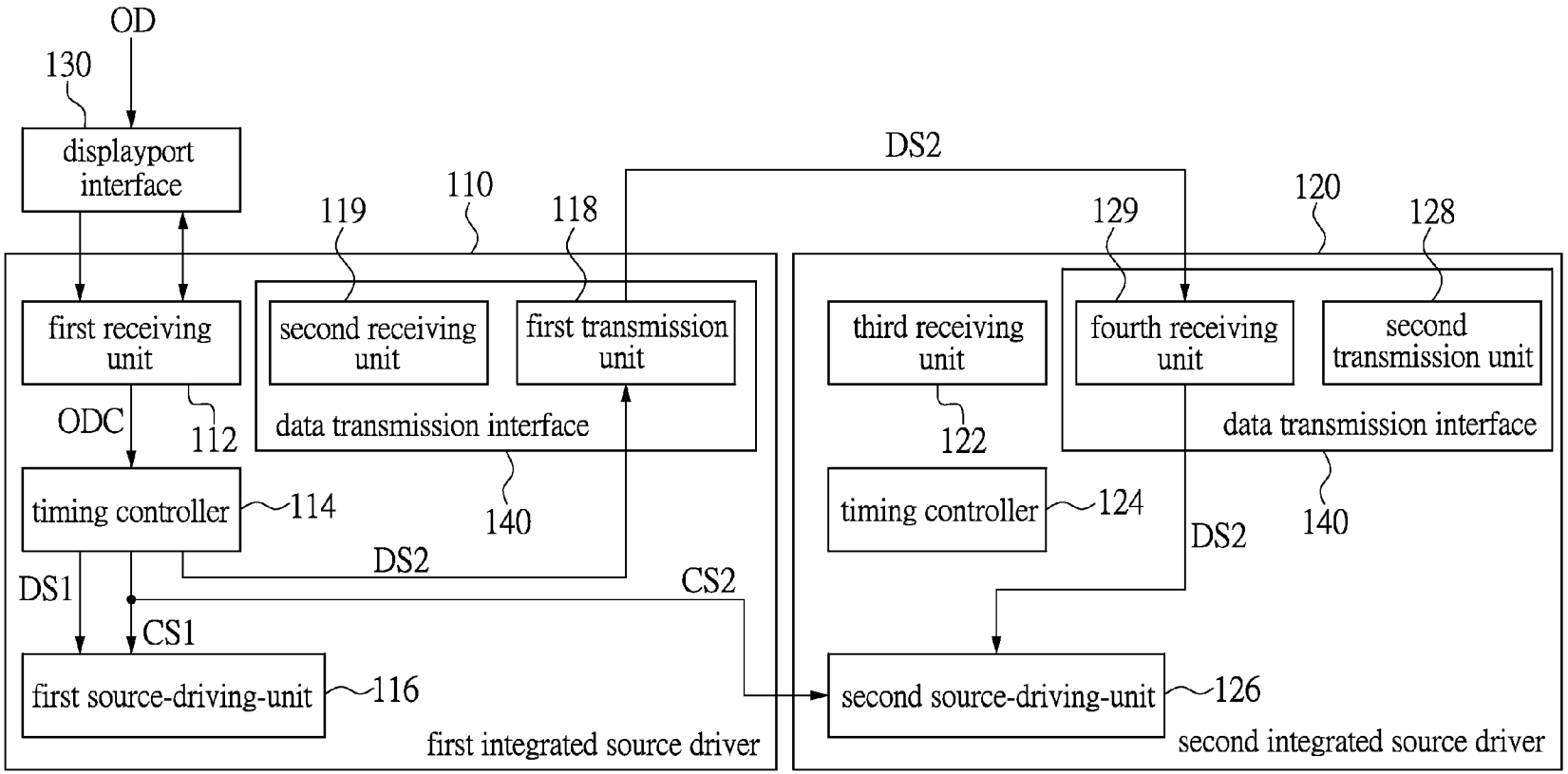
FIG. 3 shows a schematic block diagram of a source driving circuit corresponding to the embodiment in FIG. 1.

Referring to FIG. 3, FIG. 3 shows a schematic block diagram of a source driving circuit corresponding to the embodiment in FIG. 1. As shown in FIG. 3, the source driving circuit 300 includes a first integrated source driver 110 and a second integrated source driver 120. The first integrated source driver 110 includes a first receiving unit 112, a timing control 114, a first source-driving-unit 116, a first transmission unit 118, and a second receiving unit 119, wherein in the present embodiment, the first transmission unit 118 and the second receiving unit 119 are built inside a data transmission interface 140. The second integrated source driver 120 includes a third receiving unit 122, a timing controller 124, a second source-driving-unit 126, a second transmission unit 128, and a fourth receiving unit 129, wherein in the present embodiment, the second transmission unit 128 and the fourth receiving unit 129 are built inside the data transmission interface 140.

In the present embodiment, the source driving circuit is connected to a displayport interface 130, wherein the displayport interface 130 receives an original image data OD and transmits to the source driving circuit 300. The first integrated source driver 110 is connected to the displayport interface 130 through a flexible printed circuit board (not shown in FIG. 3). The second integrated source driver 120 is connected to the first integrated source driver 110. The first receiving unit 112 is connected to the displayport interface 130. The timing controller 114 is connected to the first receiving unit 112. The first source-driving-unit 116 is connected to the timing controller 114. The first transmission unit 118 is connected to the timing controller 114. The fourth receiving unit 129 is connected to the first transmission unit 118. The second source-driving-unit 126 is connected to the fourth receiving unit 129 through the data transmission interface 140.

It is worth noting that, the first integrated source driver 110 connected to the displayport interface 130 is an active driver (Master driver), but the second integrated source driver 120 is a slave driver, the data or the signal that the slave driver receives are all from the active driver 110. Thus, in another embodiment, any integrated source driver receiving data or signals from the active driver 110 may be the slave driver in the instant disclosure, and thus it is not limited because there is only one second integrated source driver 120 in the present embodiment, the one and only second integrated source driver 120 in the present embodiment is simply for an easy instruction and understanding.

Referring to FIG. 3 as well, after the first receiving unit 112 receives the original image data OD through the displayport interface 130, the first receiving unit 112 decodes the original image data OD into decoded original image data ODC, and transmits to the timing controller 114, wherein the decoded original image data ODC includes a first display data DS1 and a second display data DS2. The timing controller 114 receives the original image data ODC (i.e. the first display data DS1 and the second display data DS2) transmitted by the first receiving unit 112, the timing controller 114 will accordingly transmit the first control signal CS1 and the first display data DS1 to the first source-driving-unit 116; in the meantime, the timing controller 114 will transmit the second control signal CS2 to the second source-driving-unit 126 so as to drive the second source-driving-unit 126, and transmit the second display data DS2 to the first transmission unit 118, and then the first transmission unit 118 transforms the second display data DS2 from TTL to a differential signal. Afterwards, the data transmission interface 140 transmits the second display data DS2 of differential signal transformed by the first transmission unit 118 to the fourth receiving unit 129. Among which, the control signals CS1 and CS2 include a polarity signal, a line signal, a simultaneous signal with a frame, and a setting value of register. In other words, in the present embodiment, the first integrated source driver 110 will receive two copies of display data DS1 and DS2 from the displayport interface 130, and receive two control signals CS1 and CS2 generated by the timing controller 114, wherein one of the copies of display data DS1 and a control signal CS1 will be reserved, but the other copy of display data DS2 and the control signal CS2 will be transmitted to the second source-driving-unit 126 of the second integrated source driver 120. Accordingly, the source driving circuit 300 of the embodiment is able to be smoothly compatible with the displayport interface 130 in the same consumer electronic device, and thus is able to meet the requirement of a signal transmission and frequency demand brought by a high data transmission rate and high resolution.

Moreover, it is worth mentioning that it is to be realized from a work mechanism of the source driving circuit of the embodiment in FIG. 3, since there is no need of the function of a circuit for the second receiving unit 119 inside the first integrated source driver 110, and for the third receiving unit 122, and for the timing controller 124, and also for the second transmission unit 128 inside the second integrated source driver 120, and thus a user may switch the circuit blocks off to reduce power consumption.

Figure 4:
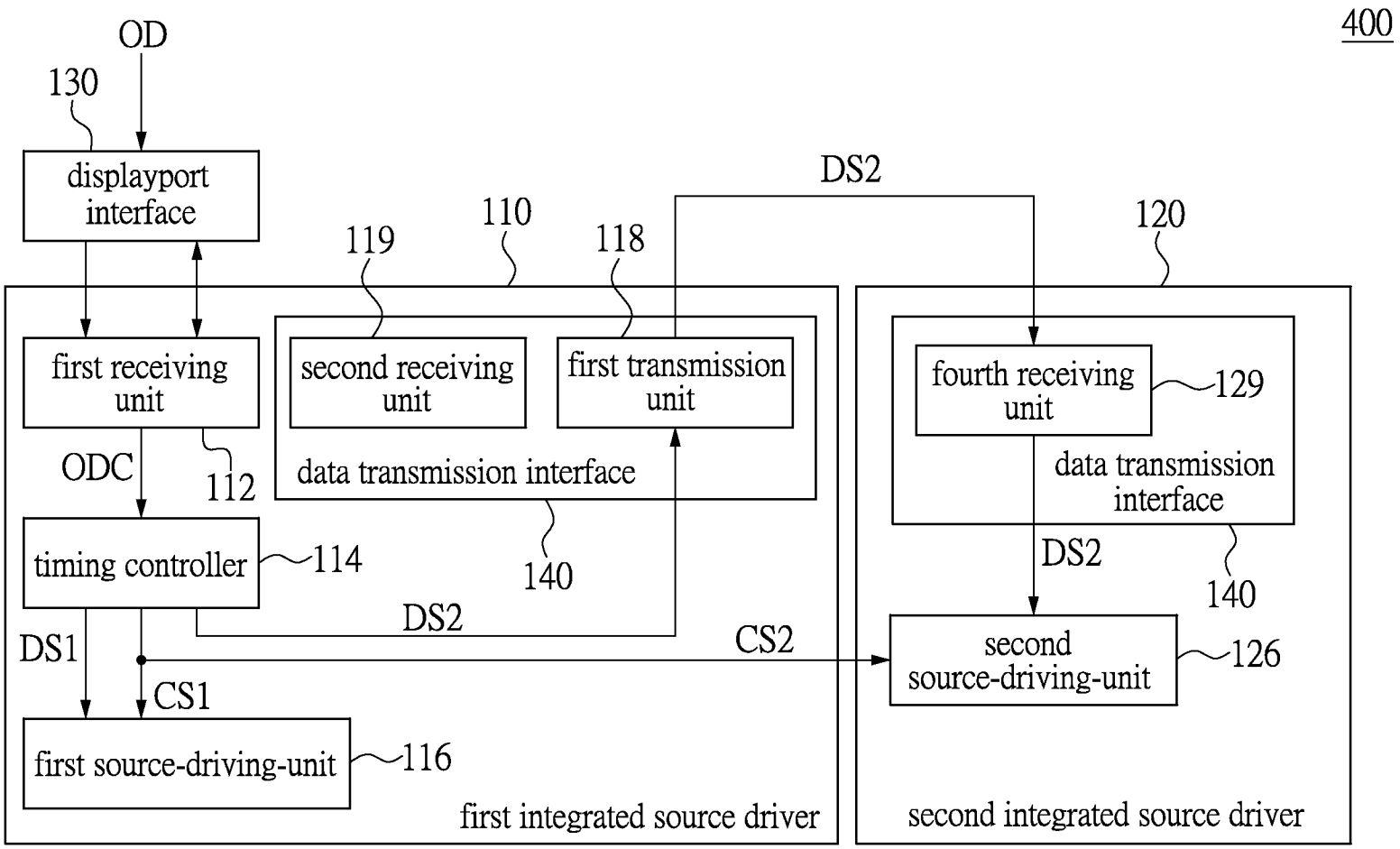
FIG. 4 shows a schematic block diagram of a source driving circuit according to an embodiment of the instant disclosure.

Furthermore, in another embodiment, please refer to FIG. 4, FIG. 4 shows a schematic block diagram of a source driving circuit according to an embodiment of the instant disclosure. It is known from FIG. 4, there are simply a second source-driving-unit 126 and a fourth receiving unit 129 in a second integrated source driver 120; therefore, in the present embodiment, the second integrated source driver 120 may be a regular source driver, and the rest of the work mechanism related to the source driving circuit 400 of the embodiment in FIG. 4 may be referred to the source driving circuit 300 of the embodiment in FIG. 3, and it is not repeated thereto.

Figure 5:
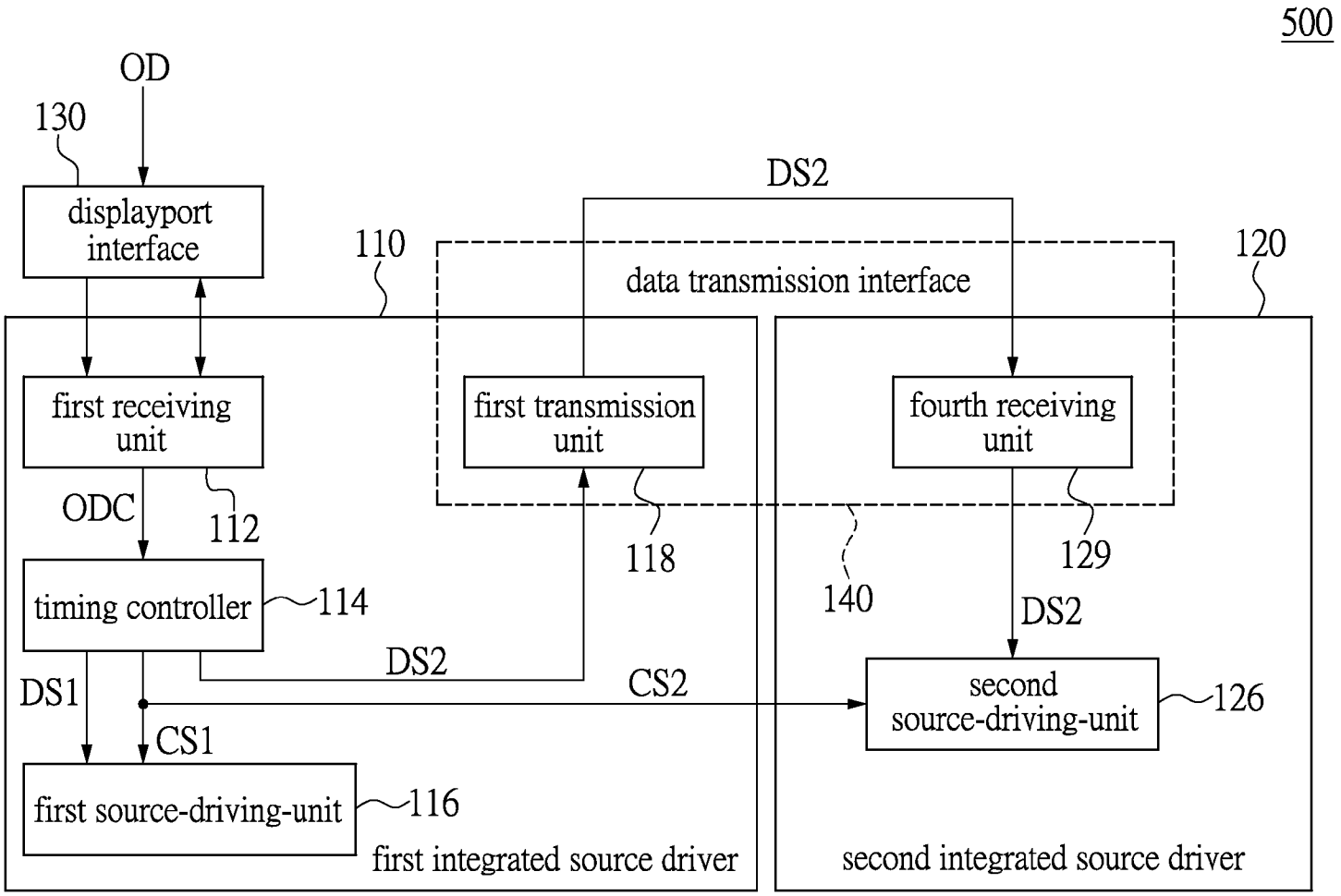
FIG. 5 shows a schematic block diagram of a source driving circuit according to an embodiment of the instant disclosure.

Last, in another embodiment, please refer to FIGS. 4 and 5 together. FIG. 5 shows a schematic block diagram of a source driving circuit according to an embodiment of the instant disclosure. It is known from FIG. 5, in comparison to the embodiment in FIG. 4, there is no need of a second receiving unit 119 in a first integrated source driver 110, and thus, in the embodiment in FIG. 5, a source driving circuit 500 can not only achieve a predetermined demand of function, but also reduce a circuit designing cost. For the rest of the working mechanism related to the source driving circuit 500 of the embodiment in FIG. 5 refer to the source driving circuit 300 of the embodiment in FIG. 3, and it is not repeated here.

Figure 6:
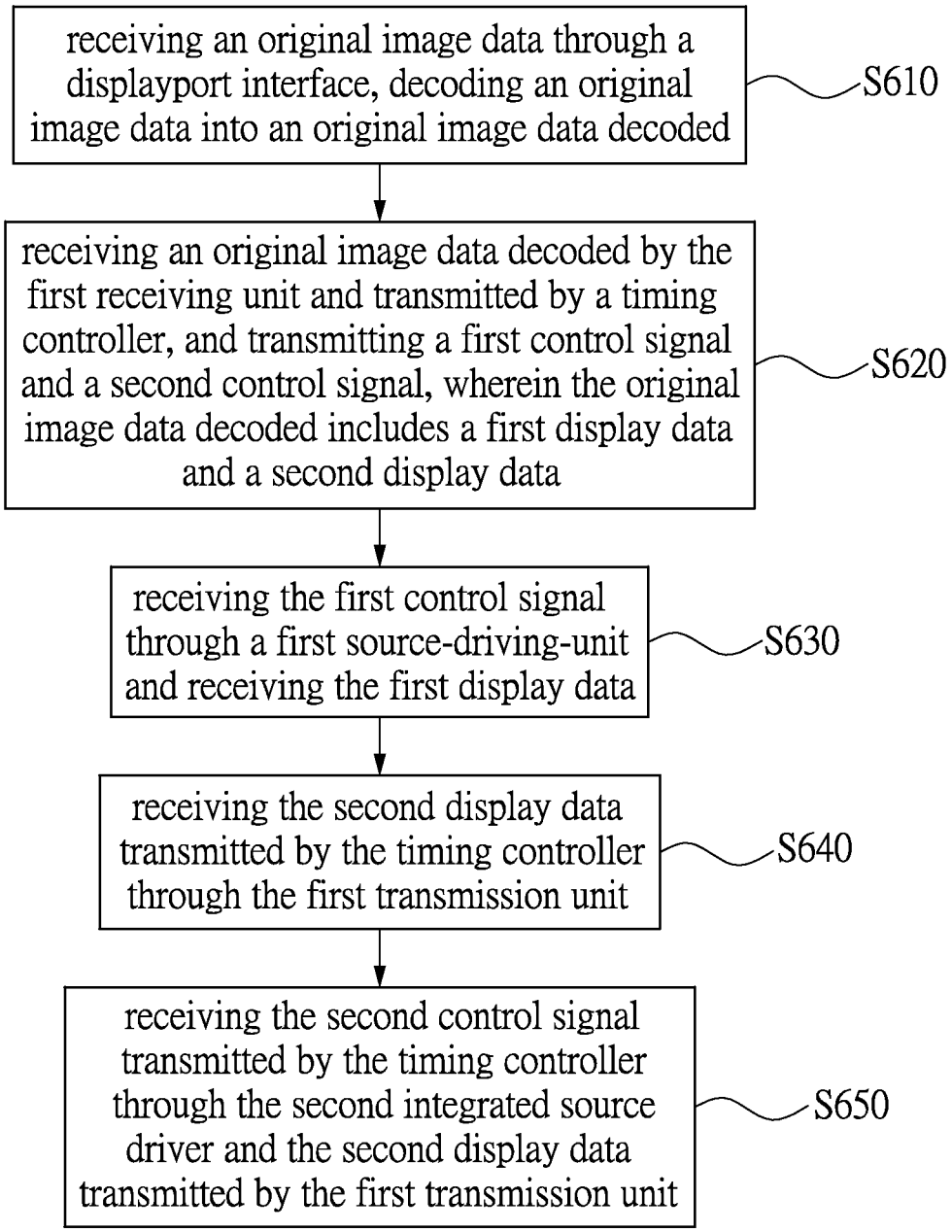
FIG. 6 shows a flow chart of a data transmission method of a source driving circuit according to an embodiment of the instant disclosure.

Referring to FIG. 6, FIG. 6 shows a flow chart of a data transmission method of a source driving circuit according to an embodiment of the instant disclosure. The method of the embodiment may be executed with source driving circuits 300, 400, and 500 in FIGS. 3-5, and thus please refer to FIGS. 3-5 together for a better understanding. A data transmission method of a source driving circuit includes steps as follows: receiving an original image data through a displayport interface, decoding an original image data into an original image data decoded (S610); receiving an original image data decoded by the first receiving unit and transmitted by a timing controller, and transmitting a first control signal and a second control signal, wherein the original image data decoded includes a first display data and a second display data (S620); receiving the first control signal through a first source-driving-unit and receiving the first display data (S630); receiving the second display data transmitted by the timing controller through the first transmission unit (S640); receiving the second control signal transmitted by the timing controller through the second integrated source driver and the second display data transmitted by the first transmission unit (S650).

Related details of steps of the data transmission method of the source driving circuit are described in the embodiments in FIGS. 1-5 as recited above, and it is not repeated thereto.

It is to be clarified that steps of the embodiment in FIG. 6 are simply for an easy instruction, and thus a sequence of the steps is not used as a condition for every embodiment of the instant disclosure.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A source driving circuit, connected to a displayport interface, wherein the displayport interface receives an original image data and transmits the original image data to the source driving circuit, and the source driving circuit comprising:

a first integrated source driver, connected to the displayport interface through a flexible printed circuit board, and the first integrated source driver comprising:

a first receiving unit, connected to the displayport interface to receive the original image data, and decoding the original image data into a decoded original image data;

a timing controller, connected to the first receiving unit;

a first source-driving-unit, connected to the timing controller to receive a first control signal and to receive a first display data;

a first transmission unit, connected to the timing controller, receiving a second display data transmitted by the timing controller; and a second integrated source driver, connected to the first integrated source driver, and receiving a second control signal transmitted by the timing controller and a second display data transmitted by the first transmission unit;

wherein the timing controller receives the decoded original image data transmitted by the first receiving unit, and transmits the first control signal to the first source-driving-unit and the second control signal to a second source-driving-unit of the second integrated source driver, wherein the decoded original image data includes the first display data and the second display data;

the second integrated source driver further comprising:

a fourth receiving unit, connected to the first transmission unit, and receiving the second display data transmitted from the first transmission unit; and the second source-driving-unit, connected to the fourth receiving unit, and receiving the second display data transmitted by the fourth receiving unit, and the second source-driving-unit further receives the second control signal transmitted by the timing controller; wherein the first transmission unit and the fourth receiving unit are built inside a data transmission interface, and receive data or signals through the data transmission interface, and the data transmission interface transmits the second display data received to the second source-driving-unit.

2. The source driving circuit according to claim 1, wherein the data transmission interface is a one-to-many interface.

3. The source driving circuit according to claim 1, wherein the first integrated source driver is an active driver (Master driver), and the second integrated source driver is a slave driver, and the data or the signals that the slave driver receives are all transmitted from the active driver.

4. A data transmission method of a source driving circuit, wherein the source driving circuit is connected to a displayport interface, wherein the displayport interface receives an original image data and transmits the original image data to the source driving circuit, and the source driving circuit comprises a first integrated source driver and a second integrated source driver; the first integrated source driver is connected to the displayport interface through a flexible printed circuit board, and the first integrated source driver comprises a first receiving unit, a timing controller, a first source-driving-unit, and a first transmission unit, wherein the first receiving unit is connected to the displayport interface, and the timing controller is connected to the first receiving unit, and the first source-driving-unit is connected to the timing controller, and the first transmission unit is connected to the timing controller and the second integrated source driver, wherein the second integrated source driver further comprising a fourth receiving unit and a second source-driving-unit, the fourth receiving unit connected to the first transmission unit and receiving a second display data; and the second source-driving-unit, connected to the fourth receiving unit and receiving the second display data transmitted by the fourth receiving unit, and the second source-driving-unit further receives the second control signal transmitted by the timing controller; wherein the first transmission unit and the fourth receiving unit are built inside a data transmission interface, and receive data or signals through the data transmission interface, and the data transmission interface transmits the second display data received to the second source-driving-unit wherein the data transmission method comprising:

the first receiving unit receiving an original image data through a displayport interface, decoding an original image data into a decoded original image data;

the timing controller receiving the decoded original image data by the first receiving unit, and transmitting the first control signal to the first source-driving-unit and the second control signal to the second source-driving-unit, wherein the decoded original image data comprises a first display data and the second display data;

the first source driving unit receiving the first control signal and the first display data by the timing controller;

the fourth receiving unit receiving the second display data transmitted by the timing control through the first transmission unit;

the second source driving unit receiving the second control signal transmitted by the timing control through the second integrated source driver and receiving the second display data transmitted by the fourth receiving unit.

5. The data transmission method according to claim 4, wherein the data transmission interface is a one-to-many interface.

6. The source driving circuit according to claim 1, wherein the first integrated source driver is an active driver (Master driver), and the second integrated source driver is a slave driver, and the data or the signals that the slave driver receives are all transmitted from the active driver.

* * * * *